United States Patent [19]

Roelevink

[11] Patent Number: 4,777,400

[45] Date of Patent: Oct. 11, 1988

[54] BLOWN LAMP BULB AND ELECTRIC LAMP PROVIDED WITH SUCH A BULB

[75] Inventor: Bauke J. Roelevink, Weert, Netherlands

[73] Assignee: U.S. Philips Corporation, New York, N.Y.

[21] Appl. No.: 22,149

[22] Filed: Mar. 5, 1987

[30] Foreign Application Priority Data

Mar. 11, 1986 [NL] Netherlands ..... 8600625

[51] Int. Cl.[4] ..... H01K 1/28

[52] U.S. Cl. ..... 313/111; 313/113; 313/315; 313/116

[58] Field of Search ..... 313/113, 111, 114, 116, 313/315, 569, 578

[56] References Cited

U.S. PATENT DOCUMENTS

| | | | |
|---|---|---|---|
| 2,115,839 | 5/1938 | Briefer | 313/113 |
| 2,170,675 | 8/1939 | Ayral | 313/111 |
| 2,901,655 | 8/1959 | Linsday et al. | 313/113 X |
| 4,041,344 | 8/1977 | LaGiusa | 313/113 |
| 4,506,185 | 3/1985 | Giller et al. | 313/113 |
| 4,633,126 | 12/1986 | Giller et al. | 313/113 |
| 4,656,386 | 4/1987 | Bloom et al. | 313/113 |
| 4,672,514 | 6/1987 | Giller | 313/113 X |

*Primary Examiner*—Palmer C. DeMeo

*Attorney, Agent, or Firm*—Algy Tamoshunas; Brian J. Wieghaus

[57] ABSTRACT

The invention relates to a blown lamp bulb having a parabolically curved wall portion, a neck-shaped wall portion near the apex of the parabolically curved wall portion. The bulb has a an axis of symmetry and a largest diameter. A curved wall portion is opposite the parabolic wall portion and has a focus which is located near the neck-shaped wall portion. The curved wall portion has a spherically curved portion having a center of curvature on the largest diameter or above it and a flattened portion proximate the axis of symmetry. The lamp bulb renders it possible to manufacture, by the choice of the finish of the lamp bulb, a large number of lamp types.

20 Claims, 2 Drawing Sheets

BLOWN LAMP BULB AND ELECTRIC LAMP PROVIDED WITH SUCH A BULB

BACKGROUND OF THE INVENTION

The invention relates to a blown lamp bulb with a glass wall comprising a substantially parabolically curved wall portion with a focus, and a neck-shaped wall portion extending from the apex of said parabolically curved wall portion to the exterior.

The bulb has a largest diameter transverse to the axis of symmetry.

The focus of the parabolically curved wall portion is located between said largest diameter and said neck-shaped wall portion near the neck-shaped wall portion. The ratio between the largest diameter and the focal distance is between 4 and 9.

A curved wall portion is opposite to said neck-shaped wall portion and said parabolically curved wall portion.

Electric incandescent lamps having such a blown lamp bulb are generally known and are commercially available. An embodiment of such an electric incandescent lamp is known, for example, from European Patent Specification No. 0 022 304 B1.

In the known lamp, the parabolically curved wall portion is provided with a mirror coating, for example with a layer of silver or of aluminum. However, instead, gold or a mixture of copper and aluminum may be applied by evaporation.

It is desired with the known lamp to direct the generated light for the major part to the exterior in directions remote from the neck-shaped wall portion. More particularly, it is desired to concentrate a largest possible fraction of this light with the mirror-coated wall portion. This object is achieved in that the light source of the lamp (a filament) is arranged in the immediate proximity of the focus of the parabolically curved wall portion and this focus is located deep in the parabolic portion near the neck-shaped wall portion. As a result, the focus is in fact enclosed by the parabolically curved wall portion over a larger spatial angle than when the focus with the same largest diameter of the lamp bulb is located, for example, on the largest diameter.

Electric lamps having a power value between 15 W and 100 W, for example of 15, 25, 40, 60, 75 and 100 W, intended to be operated at a standard voltage are manufactured in a large number of types. The finish, the coating or the processing of the lamp bulb wall, the shape of the lamp bulb and the shape of the inner parts of the lamp are different among the various types.

The following lamps are among the various types which are included in the above-mentioned power ranges:

lamps having a mirror-coated parabolically curved wall portion, opposite to which is located a window which, is glazed (is slightly light-scattering) due to an etching treatment and/or is coloured;

lamps having a substantially spherical lamp bulb which is transparent, or frosted, or which is coated with a white or coloured light-scattering layer;

lamps having a conical wall portion adjacent to and a curved wall portion opposite to the neck-shaped wall portion, the conical wall portion being provided with a white or colored light-scattering layer and the curved wall portion being slightly light-scattering and, as the case may be, being colored; these lamps emit light on all sides, but supply along the axis in directions remote from the neck-shaped wall portion a higher luminous flux than in other directions;

lamps having opposite to the neck-shaped wall portion a spherical wall portion, which is mirror-coated or is provided with a white light-scattering coating.

The manufacture of this large number of lamp types is very complicated due to the variety of bulb types, which require on the production machinery, with regard to shape and dimension, their own supply and lead-out mechanisms and transport means. The different lamp types also require different packaging. The readjustment of production machines from one lamp type to the other is thus a very laborious operation.

SUMMARY OF THE INVENTION

The invention has for its object to provide a blown lamp bulb which is suitable to be used for a large number of various types of electric lamps. The invention has further for its object to provide a variety of types of electric lamps which are manufactured from a blown lamp bulb of one kind.

According to the invention, this object is achieved in a blown lamp bulb of the kind mentioned in the opening paragraph (and in electric lamps manufactured therefrom) in that the curved wall portion comprises:

near the largest diameter a first portion which is spherically curved having a center of curvature located in the region extending from said largest diameter away from said focus, and a second, flattened portion which closes the lamp bulb opposite to the neck-shaped wall portion.

BRIEF DESCRIPTION OF THE DRAWINGS

The invention will be described and explained fully with reference to the drawings and their description.

In the drawings.

DESCRIPTION OF THE PREFERRED EMBODIMENTS

Figure 1:
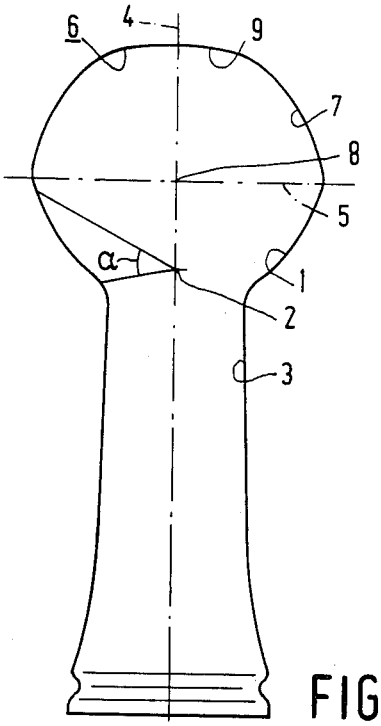
FIG. 1 is a side elevation of a first embodiment of the lamp bulb.

The blown bulb of FIG. 1 has a glass wall comprising an at least substantially parabolically curved wall portion 1 with a focus 2 and a neck-shaped wall portion 3 which extends from the apex of the parabolically curved wall portion 1 to the exterior. The bulb has an axis of symmetry 4, on which the focus 2 is located, and a largest diameter 5 transverse to this axis 4. A curved wall portion 6 is located opposite to the neck-shaped wall portion 3 and the parabolically curved wall portion 1. The focus 2 is located between the largest diameter 5 and the neck-shaped wall portion 3 near this wall portion 3, the ratio between the largest diameter and the focal distance lying between 4 and 9.

The curved wall portion 6 has near the largest diameter 5 a first, spherically curved portion 7 having a center of curvature 8 located in a region extending from the largest diameter 5 away from the focus 2 and further a second, flattened portion 9 which closes the lamp bulb opposite to the neck-shaped wall portion 3.

The general formula of a parabola is: $y^2=4\cdot f\cdot x$, where f is the focal distance. Consequently, for $x=f$ it holds that $y^2=4f^2$, from which it follows that $y=|2f|$. In the plane passing through the focus of a parabola and at right angles to the axis thereof, the branches of the parabola are therefore located at a relative distance of 4f.

In an embodiment, the lamp bulb according to the invention has a largest diameter of 60 mm, which is a diameter to which many luminaires are adapted, and a focal distance of 10 mm. The ratio between the largest diameter and the focal distance is then 6. Ratios lying between 4 and 9 are very suitable. With smaller ratios, the parabola becomes very shallow and the parabolically curved wall portion surrounds the focus only over a small spatial angle. If this wall portion is mirror-coated, this mirror is not very effective in concentrating light into a beam. With larger ratios, the bulb is very narrow to accommodate a light source at the focus and the bulb is very long to be used in conventional luminaires. Ratios between 5 and 7.5 are very favorable. In case of a largest diameter of 60 mm these ratios result in focal distances of 8 to 12 mm.

In FIG. 1, in which the said ratio is about 6, it is noticeable that the parabolically curved wall portion 1 surrounds the focus 2 over a comparatively large spatial angle $\alpha$. Since in glass no shapes with sharp transitions can be formed without the glass body becoming very vulnerable due to mechanical stresses, the transition from the wall portion 1 to the neck-shaped wall portion 3 and the transition from the wall portion 1 to the spherically curved wall portion 7 are rounded.

The center of curvature 8 of the spherically curved wall portion 7 lies in FIG. 1 on the largest diameter 5. The radius of curvature is therefore equal to half the largest diameter. The point 8 and the focus 2 are at a great relative distance.

Figure 2:
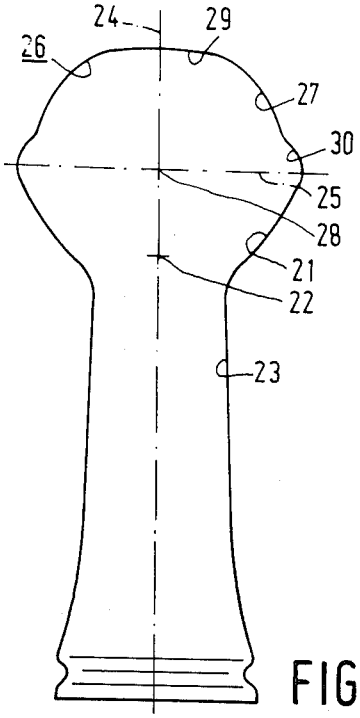
FIG. 2 is a side elevation of a second embodiment of the lamp bulb.

In FIG. 2, parts corresponding to parts in FIG. 2 have a reference numeral which is 20 higher.

From the largest diameter 25 to the neck-shaped wall portion 23, the bulb shown is identical to that of FIG. 1. However, the bulb is distinguished in that a third, annular portion 30 forms part of the curved wall portion 26, this portion 30 being interposed between the spherically curved portion 27 and the largest diameter 25. The center of curvature 28 of the spherically curved portion 27 lies on the largest diameter 25.

Lamps in which the parabolic wall portion 21 is mirror-coated are often used in narrow luminaires, in which they are arranged at a fairly great depth. As a result, it is difficult to arrange such a lamp in the luminaire and to remove it therefrom. The spherical portion 27, whose radius of curvature is smaller than half the largest diameter 25, facilitates the removal of a lamp with the bulb shown in such narrow luminaires.

Figure 3:
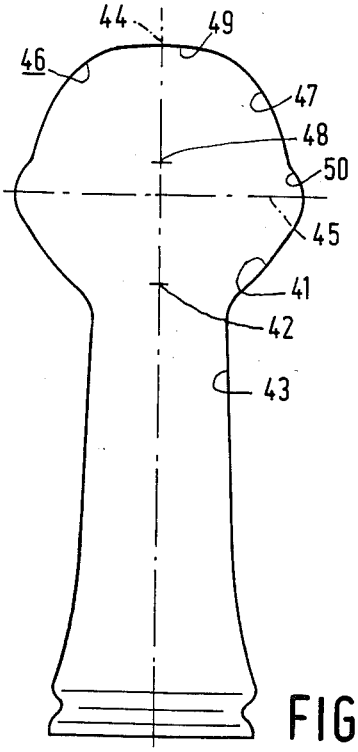
FIG. 3 is a side elevation of a third embodiment of the lamp bulb.

In FIG. 3, parts corresponding to parts in FIG. 2 have a reference numeral which is 20 higher than in FIG. 2. The center of curvature 48 in this Figure is farther remote from the focus 42 than the transverse plane at the largest diameter 45.

The following Figures illustrate the large field of use of the bulb according to the invention.

Figure 4:
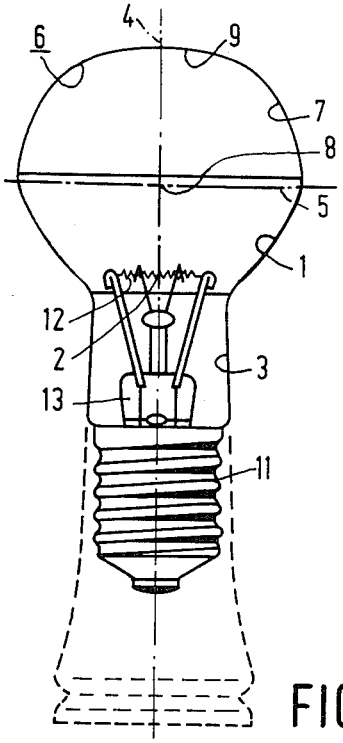
FIG. 4 shows, partly broken away, the bulb of FIG. 1 provided with a coating and processed to a lamp.

In FIG. 4, the bulb of FIG. 1 is processed to an incandescent lamp. The bulb part that was removed during the manufacture of the lamp is indicated by dotted lines in this Figure and the following Figures. The parabolically curved wall portion 1 is provided with a mirror coating by applying aluminum by vapor deposition. A filament 12 is mounted on a stem mount 13 and is arranged to surround the axis 4 at the level of the focus 2. The lamp has a lamp cap 11.

The lamp shown is a reflector lamp, which throws to the exterior a large part of the generated light in a concentrated beam, i.e. after reflection by the mirror-coated wall portion 1 through the curved wall portion 6, while another part emanates directly through the wall portion 6. As a result, the lamp supplies a large luminous flux in the axial direction and in directions enclosing a small angle with the axis 4. Similar lamps may be manufactured with the bulbs of FIGS. 2 and 3.

Figure 5:
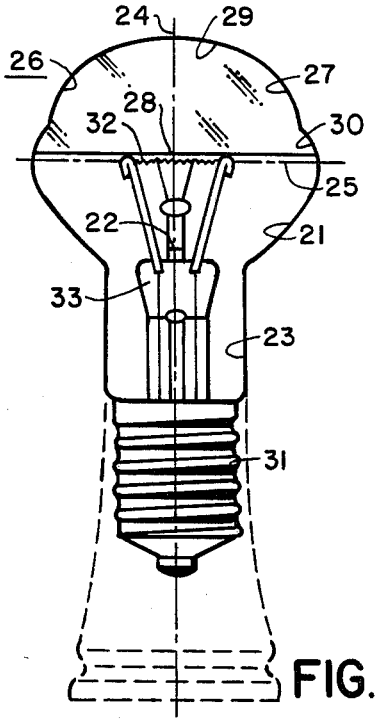
FIG. 5 shows the bulb of FIG. 2 provided with a coating and processed to a lamp.

FIG. 5 shows a lamp manufactured from the bulb shown in FIG. 2, but similar lamps may be obtained from the bulbs of FIGS. 1 and 3.

The curved wall portion 26 is provided with a mirror-coating, for example of copper-aluminum. A filament 32 mounted on a stem mount 33 surrounds the axis 24 at the level of the center of curvature 28. The spherically curved mirror-coated portion 27 reflects light to the exterior through the parabolically curved wall portion 21. The filament also emits radiation directly through this wall portion to the exterior.

The lamp is intended to be used together with a parabolic reflector, which surrounds the neck-shaped wall portion 23 and whose focus coincides with the center of curvature 28. This reflector directs the light away from the lamp at least substantially parallel to the axis 24 of the lamp cap 31. The flattened mirror-coated portion 29 and the annular mirror-coated portion 30 also throw light back to this external reflector. The flattened portion 29 has advantages as compared with a portion 29 having its center of curvature at point 28. The latter wall portion would then throw much light into the neck-shaped portion 23 of the bulb, in which the light would be lost. The lamp produces together with an external reflector a very narrow light beam having a very high luminous intensity in proportion to the power consumed.

Lamps identical with regard to the construction of the filament 32 and the stem mount 33 and with regard to the position of the filament 32 can be manufactured with bulbs of FIGS. 1 to 3, which have no finish or have a finish other than a mirror coating.

Figure 6:
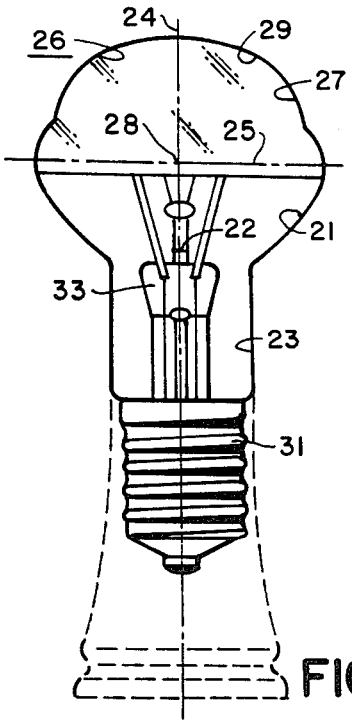
FIG. 6 shows the bulb of FIG. 2 provided with a coating and processed to a lamp.

FIG. 6 shows such a lamp manufactured from the bulb shown in FIG. 2, the curved wall portion 26 having a white powder layer. The layer reflects a part of the incident light, but scatters another part. The lamp produces partly diffuse direct light and partly an indirect beam formed by means of a reflector.

Figure 7:
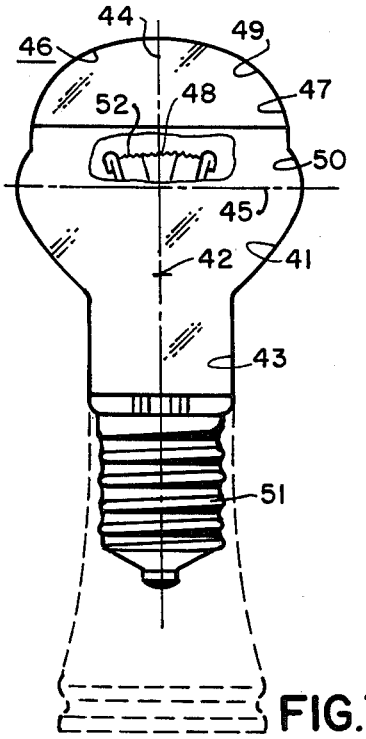
FIG. 7 shows, partly broken away, the bulb of FIG. 3 provided with a coating and processed to a lamp.

In the lamp shown in FIG. 7 manufactured from the bulb shown in FIG. 3, the flattened portion 49 and an adjoining part of the spherically curved portion 47 is slightly light scattering. This may be achieved in that the bulb is etched in this region or in that the bulb is frosted in this region in another manner, for example in that it is provided with a light scattering coating. The annular portion 50, the adjoining part of the spherically curved portion 47, the parabolically curved wall portion 41 and a large part of the neck-shaped wall portion 43 are provided with a white light-scattering coating.

The filament 52 is arranged to surround the axis 44 at the level of the center of curvature 48.

The white coating causes a part of the incident light to emanate in a diffuse manner and reflects another part. The latter part contributes to the luminous flux leaving the lamp along the axis 44 in directions remote from the lamp cap 51. The lamp consequently emits light on all sides, but with a considerably higher intensity in the said directions. Lamps which are identical with regard to construction, shape and position of the filament and the stem mount, can also be obtained with the bulbs shown in FIGS. 1 and 2, when they have been given a similar finish.

With the lamp bulbs according to the invention, a large variety of lamp types can consequently be realized, in which the filament is situated either at the level of the focus or at the level of the center of curvature. The assembly of filament and stem mount is then limited per power value of the filament to two types. It is of essential importance that the focus and the center of curvature are mutually separated in space.

GB No. 2 097 997 corresponding to U.S. Pat. No. 4,506,185 discloses a lamp in which the focus of a mirror-coated parabolic wall portion coincides with the centre of curvature of a spherical mirror-coated wall portion. This known lamp has an object differing from the claimed invention which is to solely emit light concentrated to a beam (reflected by the mirrors). For this purpose, two mirror-coated wall portions and a coinciding focus and center of curvature are necessary. Geometrically the lamp vessel of that lamp is not suitable for the object aimed at by the claimed invention.

What is claimed is:

1. A blown lamp bulb having a glass wall, comprising:

an at least substantially parabolically curved wall portion with a focus, a neck-shaped wall portion extending from the apex of said parabolically curved wall portion to the exterior, an axis of symmetry a largest diameter transverse to the axis of symmetry, the focus of said parabolically curved wall portion being located between said largest diameter and said neck-shaped wall portion near the neck-shaped wall portion, the ratio between the largest diameter and the focal distance lying between 4 and 9, and a curved wall portion opposite to said neck-shaped wall portion and said parabolically curved wall portion, characterized in that the curved portion comprises:

near said largest diameter a first, spherically curved portion with a center of curvature located in a region extending from said largest diameter away from said focus, and a second, flattened portion which closes the lamp bulb opposite to the neck-shaped wall portion.

2. A blown lamp bulb as claimed in claim 1, characterized in that the curved wall portion has a third annular portion between the first spherically curved portion and the largest diameter.

3. A blown lamp bulb as claimed in claim 2, characterized in that the center of curvature of the spherically curved portion is remote from the largest diameter.

4. A blown lamp bulb as claimed in claim 3, characterized in that the parabolically curved wall portion is provided with a mirror coating and the remaining wall portions are mainly translucent.

5. A blown lamp bulb as claimed in claim 3, characterized in that the curved wall portion is provided with a mirror coating and in that the remaining wall portions are mainly translucent.

6. A blown lamp bulb as claimed in claim 3, characterized in that the curved wall portion is provided with a white light-scattering coating and in that the remaining wall portions are mainly transparent.

7. A blown lamp bulb as claimed in claim 3, characterized in that the second, flattened portion of the curved wall portion and an adjoining part of the first, spherically curved portion are frosted and in that the remaining part of the bulb is provided at least substantially entirely with a white light-scattering coating.

8. An electric incandescent lamp provided with a blown lamp bulb as claimed in claim 3.

9. An electric incandescent lamp as claimed in claim 8, characterized in that the parabolically curved wall portion is provided with a mirror coating and the remaining wall portions are mainly translucent and in that the filament surrounds the axis of symmetry at the level of the focus.

10. An electric incandescent lamp as claimed in claim 8, characterized in that the curved wall portion is provided with a mirror coating and in that the remaining wall portions are mainly translucent, while the filament surrounds the axis of symmetry at the level of the center of curvature.

11. An electric incandescent lamp as claimed in claim 8, characterized in that the curved wall portion is provided with a white light-scattering coating and in that the remaining wall portions are mainly translucent, while the filament surrounds the axis of symmetry at the level of the center of curvature.

12. An electric incandescent lamp as claimed in claim 8, characterized in that the second flattened part of the curved wall portion and the adjoining part of the first spherically curved portion are frosted and in that the remaining part of the bulb is provided at least substantially entirely with a white light-scattering coating, while the filament surrounds the axis of symmetry at the level of the center of curvature.

13. A blown lamp bulb as claimed in claim 1, characterized in that the parabolically curved wall portion is provided with a mirror coating and the remaining wall portions are mainly translucent.

14. A blown lamp bulb as claimed in claim 1, characterized in that the curved wall portion is provided with a mirror coating and in that the remaining wall portion are mainly translucent.

15. A blown lamp bulb as claimed in claim 1, characterized in that the curved wall portion is provided with a white light-scattering coating and in that the remaining wall portions are mainly transparent.

16. A blown lamp as claimed in claim 1, characterized in that the second, flattened portion of the curved wall portion and an adjoining part of the first, spherically curved portion are frosted and in that the remaining part of the bulb is provided with a least substantially entirely with a white light-scattering coating.

17. An electric incandescent lamp provided with a blown lamp bulb as claimed in claim 1.

18. An electric incandescent lamp as claimed in claim 17, characterized in that the parabolically curved wall portion is provided with a mirror coating and remaining wall portions are mainly translucent and in that the filament surrounds the axis of symmetry at the level of the focus.

19. An electric incandescent lamp as claimed in claim 17, characterized in that the curved wall portion is provided with a mirror coating and in that the remaining wall portions are mainly translucent, while the filament surrounds the axis of symmetry at the level of the center of curvature.

20. An electric incandescent lamp as claimed in claim 17, characterized in that the curved wall portion is provided with a white light-scattering coating and in that the remaining wall portions are mainly translucent, while the filament surrounds the axis of symmetry at the level of the center of curvature.

* * * * *